US009709954B2

(12) United States Patent
Dubois et al.

(10) Patent No.: US 9,709,954 B2
(45) Date of Patent: Jul. 18, 2017

(54) TIMEPIECE ASSORTMENT USING AN AMORPHOUS METAL ALLOY

(71) Applicant: Nivarox-FAR S.A., Le Locle (CH)

(72) Inventors: Philippe Dubois, Marin (CH); Yves Winkler, Schmitten (CH); Daniel Mallet, Le Belieu (FR); Christian Charbon, Chezard-St-Martin (CH)

(73) Assignee: Nivarox-FAR S.A., Le Locle (CH)

( * ) Notice: Subject to any disclaimer, the term of this patent is extended or adjusted under 35 U.S.C. 154(b) by 95 days.

(21) Appl. No.: 14/669,127

(22) Filed: Mar. 26, 2015

(65) Prior Publication Data

US 2015/0286188 A1 Oct. 8, 2015

(30) Foreign Application Priority Data

Apr. 7, 2014 (EP) ..... 14163754

(51) Int. Cl.
*G04B 13/02* (2006.01)
*G04B 17/32* (2006.01)

(52) U.S. Cl.
CPC ..... *G04B 13/026* (2013.01); *G04B 13/022* (2013.01); *G04B 17/32* (2013.01); *Y10T 29/49581* (2015.01)

(58) Field of Classification Search
CPC ..... G04B 1/145; G04B 13/02; G04B 13/021; G04B 13/22; G04B 13/026; G04B 15/14; G04B 17/32; Y10T 29/49581
See application file for complete search history.

(56) References Cited

U.S. PATENT DOCUMENTS

| | | | | |
|---|---|---|---|---|
| 3,396,450 | A * | 8/1968 | Faehndrich | G04B 17/345 264/279.1 |
| 9,315,884 | B2 * | 4/2016 | Aljerf | C22C 45/02 |
| 2012/0090933 | A1 | 4/2012 | Conus et al. | |
| 2012/0159766 | A1 * | 6/2012 | Verardo | G04B 13/02 29/520 |
| 2012/0159767 | A1 * | 6/2012 | Verardo | G04B 13/022 29/520 |
| 2013/0145811 | A1 | 6/2013 | Winkler et al. | |
| 2013/0167981 | A1 | 7/2013 | Winkler et al. | |

FOREIGN PATENT DOCUMENTS

| | | |
|---|---|---|
| CH | 699 147 B1 | 1/2010 |
| CH | 699 680 A2 | 4/2010 |
| CH | 706 645 A1 | 12/2013 |
| EP | 2 442 189 A1 | 4/2012 |
| EP | 2 469 351 A1 | 6/2012 |
| WO | WO 2011/161138 A1 | 12/2011 |

OTHER PUBLICATIONS

European Search Report issued Dec. 18, 2014 in European application 14163754, filed on Apr. 7, 2014 ( with English Translation).

* cited by examiner

*Primary Examiner* — Vit W Miska
(74) *Attorney, Agent, or Firm* — Oblon, McClelland, Maier & Neustadt, L.L.P.

(57) ABSTRACT

The invention relates to a timepiece assortment including a timepiece component fixed to an arbor with the aid of a fixing element. According to the invention, the fixing element is made of at least partially amorphous metal alloy, is secured to the timepiece component by partial insertion and includes a hole into which the arbor is driven.

16 Claims, 8 Drawing Sheets

TIMEPIECE ASSORTMENT USING AN AMORPHOUS METAL ALLOY

This application claims priority from European patent application No. 14163754.6 filed Apr. 7, 2014, the entire disclosure of which is hereby incorporated herein by reference.

FIELD OF THE INVENTION

The invention relates to a timepiece assortment using an amorphous metal alloy and particularly such an assortment including a timepiece component whose material has no usable plastic range, i.e. with a very limited plastic range.

BACKGROUND OF THE INVENTION

Current assemblies including a silicon-based part are generally secured by adhesive bonding. This type of operation requires extremely delicate application which makes it expensive.

SUMMARY OF THE INVENTION

It is an object of the present invention to overcome all or part of the aforecited drawbacks by proposing a timepiece assortment that does not use adhesive to fix, in particular, a component made of brittle material to an arbor.

To this end, according to a first embodiment, the invention relates to a timepiece assortment including a timepiece component fixed to an arbor with the aid of a fixing element including a hole into which said arbor is driven, characterized in that the fixing element is made of an at least partially amorphous metal alloy and is secured to the timepiece component by partial insertion of one into the other, and in that the timepiece component includes an opening which extends around the hole in the fixing element and has a larger cross-section so as to leave a gap between the wall of the opening and the arbor.

According to other advantageous variants of the first embodiment of the invention:

- the timepiece component or the fixing element is mounted against a shoulder of the arbor;
- at least one fifth of the height of the timepiece component is covered by the fixing element;
- the timepiece component includes at least one recess for increasing the contact surface with the fixing element.

According to a second embodiment, the invention relates to a timepiece assortment including a timepiece component fixed to an arbor with the aid of a fixing element and a driving-in member including a hole into which said arbor is driven, characterized in that the fixing element is made of an at least partially amorphous metal alloy, is respectively secured to the timepiece component and to the driving-in member by partial insertion of one into the other and in that the timepiece component includes an opening which extends around the hole in the driving-in member and has a larger cross-section so as to leave a gap between the wall of the opening and the arbor.

According to other advantageous variants of the second embodiment of the invention:

- the timepiece component or the driving-in member is mounted against a shoulder of the arbor;
- at least one fifth of the height of the timepiece component and that of the driving-in member are covered by the fixing element;

- the driving-in member and/or the timepiece component include at least one recess for increasing the contact surface with the fixing element;
- the driving-in member is formed of a metal or a metal alloy.

According to these two embodiments, it is advantageously understood according to the invention, that simply by means of the partial insertion of the timepiece component into the fixing element, it is no longer necessary to implement adhesive bonding. Indeed, under certain conditions explained below, an at least partially amorphous metal alloy advantageously makes it possible to adopt the shape of any object in the manner of a deformable paste. This malleability of the fixing element combined with the surface roughness of the partially covered component offers sufficient adherence for a timepiece application.

According to other advantageous variants of the first and second embodiments of the invention:

- the timepiece component includes doped or undoped single crystal silicon, doped or undoped polycrystalline silicon, silicon oxide, quartz, silica, single crystal corundum, polycrystalline corundum, alumina, ruby, silicon nitride, silicon carbide;
- the timepiece component includes at least one partial coating of silicon oxide, silicon nitride, silicon carbide or an allotrope of carbon;
- the fixing element is formed of a magnesium-based, titanium-based, zirconium-based, iron-based, cobalt-based, gold-based, palladium-based or platinum-based alloy;
- the fixing element is formed by an alloy with an at least partially amorphous structure of the ZrTiCuNiBe, PdCuNiP or PtCuNiP type;
- the assortment forms all or part of a gear train such as a wheel, a pinion, an oscillating weight or a spring;
- the assortment forms all or part of an escapement system such as an escape wheel, a pallet lever, a pallet guard pin or a pallet fork;
- the assortment forms all or part of a resonator such as a balance, a roller or a balance spring.

More generally, the invention relates to a timepiece, characterized in that it includes a timepiece assortment according to any of the preceding variants.

According to a first embodiment, the invention also relate to a method for assembling a timepiece assortment including the following steps:

a) separately manufacturing a timepiece component and a fixing element, said fixing element being manufactured from an at least partially amorphous metal alloy;

b) partially inserting at least one portion of the timepiece component into the thickness of the fixing element heated to between its vitreous transition temperature and its crystallisation temperature in order to form a timepiece component-fixing element assembly;

c) driving an arbor into a hole in the fixing element to form the timepiece assortment so as to leave a gap between timepiece component and the arbor.

According to other advantageous variants of the first embodiment of the invention:

- the hole is formed in step a), in step b) or in step c);
- the method further includes, between step b) and step c), step d): maintaining the timepiece component-fixing element assembly above the vitreous transition temperature of the fixing element in order to make the fixing element more ductile;
- step c) comprises a first phase c1) for heating the arbor above the vitreous transition temperature of the fixing element and a second phase c2) for driving the arbor into the hole of the fixing element or of the driving-in member in order to raise the temperature of the contact surface of the fixing element above its vitreous transition temperature in order to locally soften the fixing element to reduce the stresses on the material of the timepiece component while maintaining good adherence;

the arbor includes a shoulder and, either the timepiece component or the fixing element is pressed against the shoulder of the arbor in driving-in step c);

the timepiece component includes recesses for increasing the contact surface with the fixing element;

a template is used in step b) to guarantee the geometry of the fixing element;

a spacer is used in step b) to guarantee the depth of penetration of the timepiece component into the thickness of the fixing element.

Finally, according to a second embodiment, the invention relates to a method for assembling a timepiece assortment including the following steps:

a') separately manufacturing a timepiece component, a fixing element made of an at least partially amorphous metal alloy and a driving-in member provided with a hole;

b') partially inserting at least one portion of the timepiece component and of the driving-in member into the thickness of the fixing element heated to between its vitreous transition temperature and its crystallisation temperature to form a timepiece component-fixing element-driving-in member assembly;

c') driving an arbor into the hole in the driving-in member to form the timepiece assortment so as to leave a gap between timepiece component and the arbor.

According to other advantageous variants of the second embodiment of the invention:

the arbor includes a shoulder and the timepiece component or the driving-in member is pressed against the shoulder of the arbor in driving-in step c');

the timepiece component includes at least one recess for increasing the contact surface with the fixing element;

the driving-in member includes at least one recess for increasing the contact surface with the fixing element;

a template is used in step b') to guarantee the geometry of the fixing element;

a spacer is used in step b') to guarantee the depth of penetration of the timepiece component and of the driving-in member into the thickness of the fixing element.

According to these two embodiments, it is understood that, advantageously according to the invention, the fixing element made of an at least partially amorphous metal alloy will perfectly adopt the shape of one portion of the timepiece component, and, where appropriate, of the driving-in member, allowing it to adhere firmly thereto without the need to implement adhesive bonding. Advantageously according to the invention, no chemical bond is used to secure the elements to each other. Thus, the elements are secured to each other only by the surface roughness of the elements. In this regard, the method allows the saving of chemical cleaning, that is to say that a high standard of cleanliness, such as for electronic components, is unnecessary.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

The invention relates to a timepiece assortment for a timepiece using an amorphous metal alloy and particularly such an assortment including a timepiece component whose material has no usable plastic range, i.e. with a very limited plastic range.

This material may, in a non-limiting manner, be doped or undoped single crystal silicon, doped or undoped polycrystalline silicon, silicon oxide, quartz, silica, single crystal corundum, polycrystalline corundum, alumina, ruby, silicon nitride or silicon carbide. The material may include at least a partial coating of silicon oxide, silicon nitride, silicon carbide or an allotrope of carbon. Of course, other types of material such as other ceramics may be envisaged, as may other types of coating.

Figure 9:
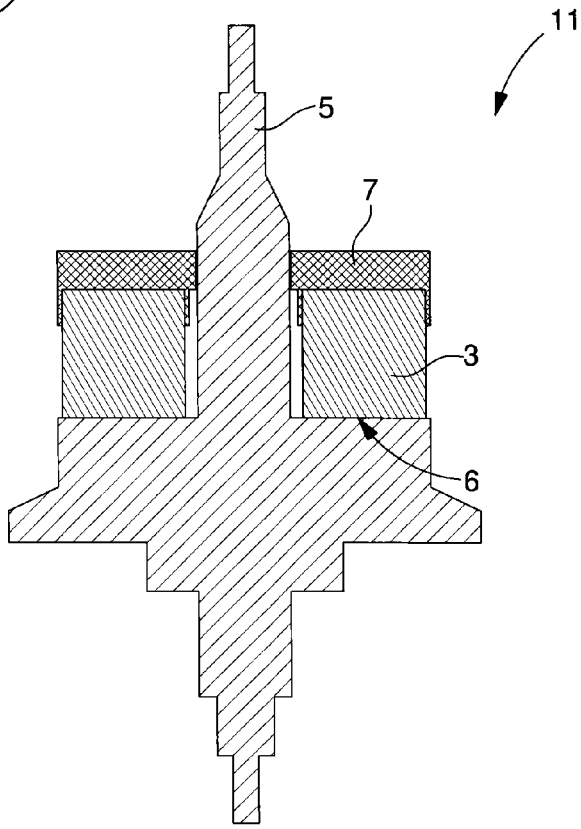
FIG. 9 is an alternative assembly of FIG. 8.
Figure 8:
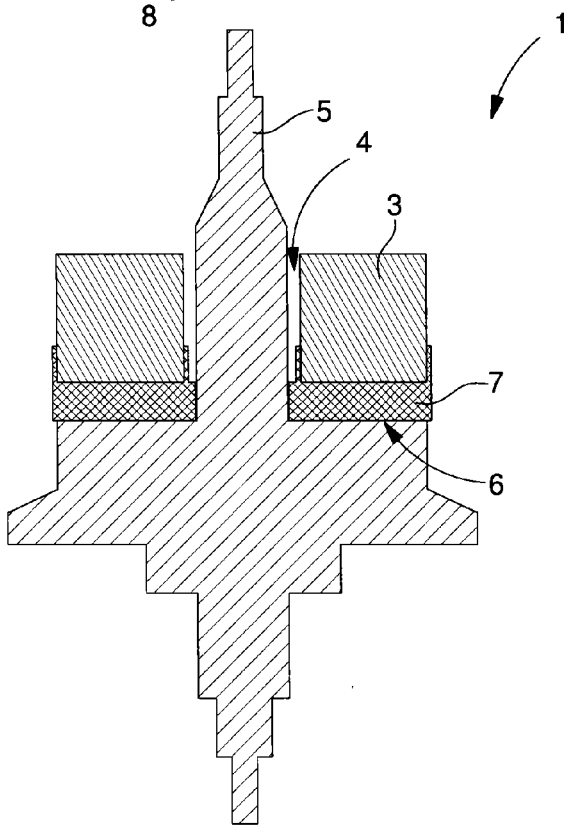

According to a first embodiment of the invention illustrated, in particular, in FIGS. 8 and 9, the timepiece assortment 1, 11, 21 includes a timepiece component 3, 13 fixed to an arbor 5 with the aid of a fixing element 7, 17. Advantageously according to the invention, fixing element 7, 17 is made of an at least partially amorphous metal alloy and is secured to timepiece component 3, 13 by partial insertion in as seen in FIGS. 8 and 9. Further, advantageously according to the invention, fixing element 7, 17 includes a hole 8, 18 into which arbor 5 is driven.

It is understood, advantageously according to the invention, that simply by partially covering timepiece component 3, 13 with fixing element 7, 17, it is no longer necessary to implement adhesive bonding. Indeed, under certain conditions explained below, an at least partially amorphous metal alloy advantageously makes it possible to adopt the shape of any object in the manner of a deformable paste. This malleability of fixing element 7 combined with the surface roughness of timepiece component 3, 13 offers sufficient adherence for a timepiece application.

Advantageously according to the invention, according to a first alternative of the first embodiment, assortment 1 includes a fixing element 7 which is mounted against a shoulder 6 of arbor 5, as illustrated in FIG. 8. This first alternative prevents timepiece component 3 from touching arbor 5. Indeed, preferably according to the invention, timepiece component 3 includes, like fixing element 7, an opening 4 of larger cross-section than hole 8.

According to a second alternative of the first embodiment, assortment 11 includes, conversely, a timepiece component 3 which is mounted against a shoulder 6 of arbor 5, as illustrated in FIG. 9. This second alternative guarantees optimum perpendicularity of timepiece component 3 relative to arbor 5. Indeed, preferably according to the invention, since timepiece component 3 is pressed between shoulder 6 and fixing element 7, its position has fewer degrees of freedom.

Preferably according to the invention, it was found that at least one fifth of the height of timepiece component 3, 13 covered by fixing element 7, 17 provides secure attachment when the height of timepiece component 3, 13 is comprised between 100 and 500 μm. Further, preferentially, it was also found that secure insertion is obtained with a minimum thickness of 50 μm of fixing element 7, 17 at the hole 8, 18 not covering timepiece component 3, 13.

Preferentially according to the invention, fixing element 7, 17 is a magnesium-based, titanium-based, zirconium-based, iron-based, cobalt-based, gold-based, palladium-based or platinum-based alloy. More specifically, a fixing element 7, 17 formed by an alloy with an at least partially amorphous structure of the ZrTiCuNiBe, PdCuNiP or PtCuNiP type has proved satisfactory in each case.

Figure 12:
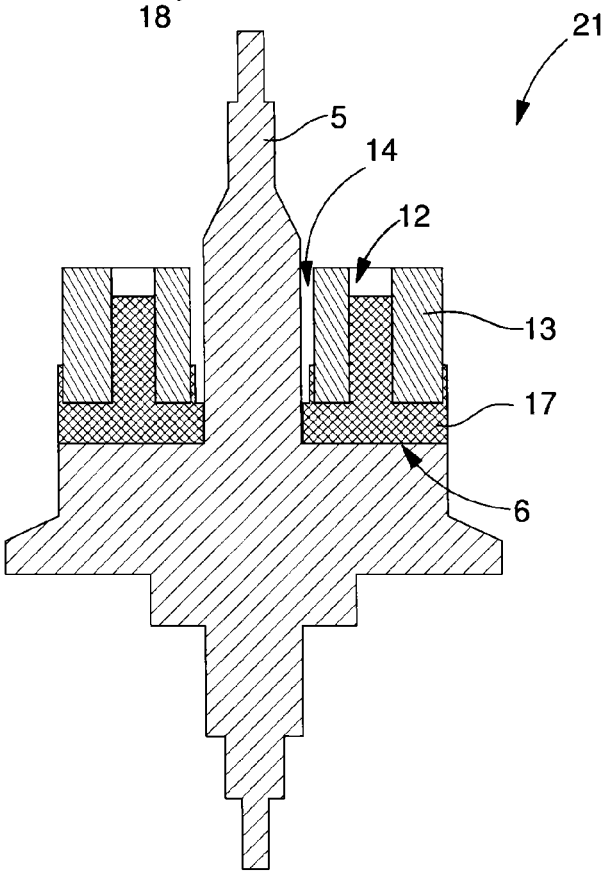

According to a variant of the first embodiment seen in FIG. 12, assortment 21 includes a timepiece component 13 formed with at least one recess 12 for increasing the surface contact with fixing element 17. Each recess 12 may be blind or through recess and can be positioned in any manner facing fixing element 17.

In the example illustrated in FIG. 12, fixing element 17 is mounted against a shoulder 6 of arbor 5. However, of course, this variant with a timepiece component 13 formed with at least one recess 12 may also be assembled according to the aforecited second alternative of FIG. 9, that is to say with the timepiece component 13 mounted against shoulder 6 of arbor 5.

It is immediately understood that timepiece assortment 1, 11, 21 can thus form all or part of a gear train 101, of an escapement system 103 or of a resonator 105. More specifically, timepiece component 3, 13 may thus form a wheel 102, a pinion 104, 112 of an oscillating weight 106, a spring (such as for example a mainspring), an escape wheel 107, a lever 108 of a pallets 109, a guard pin 110 of a pallets 109, a fork 111 of a pallets 109, a balance 113, a roller (such as for example a double roller holding an impulse pin) or a balance spring 115.

Figure 14:
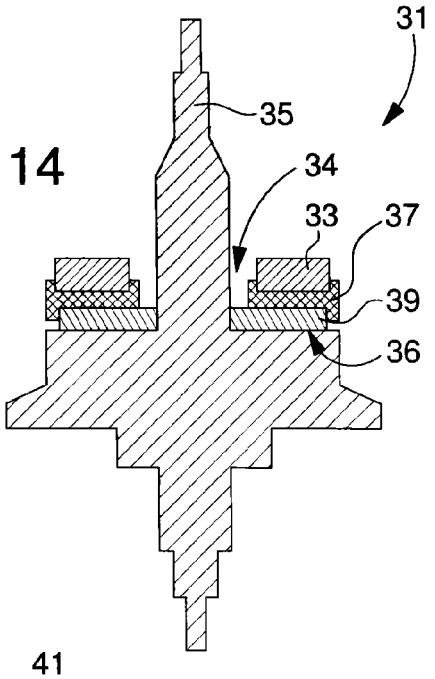
Figure 15:
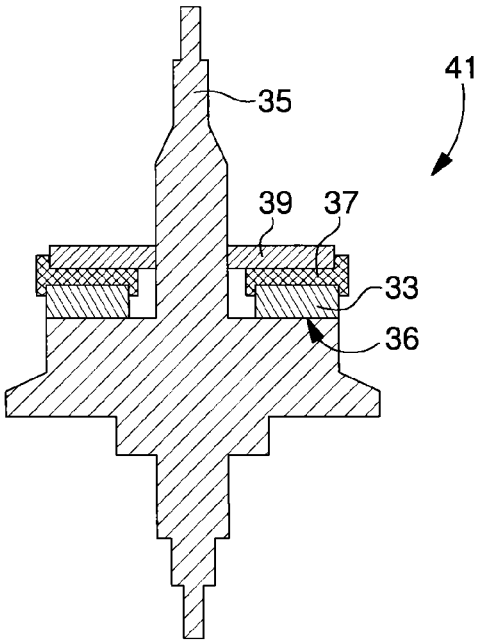
FIG. 15 is an alternative assembly of FIG. 14.
Figure 17:
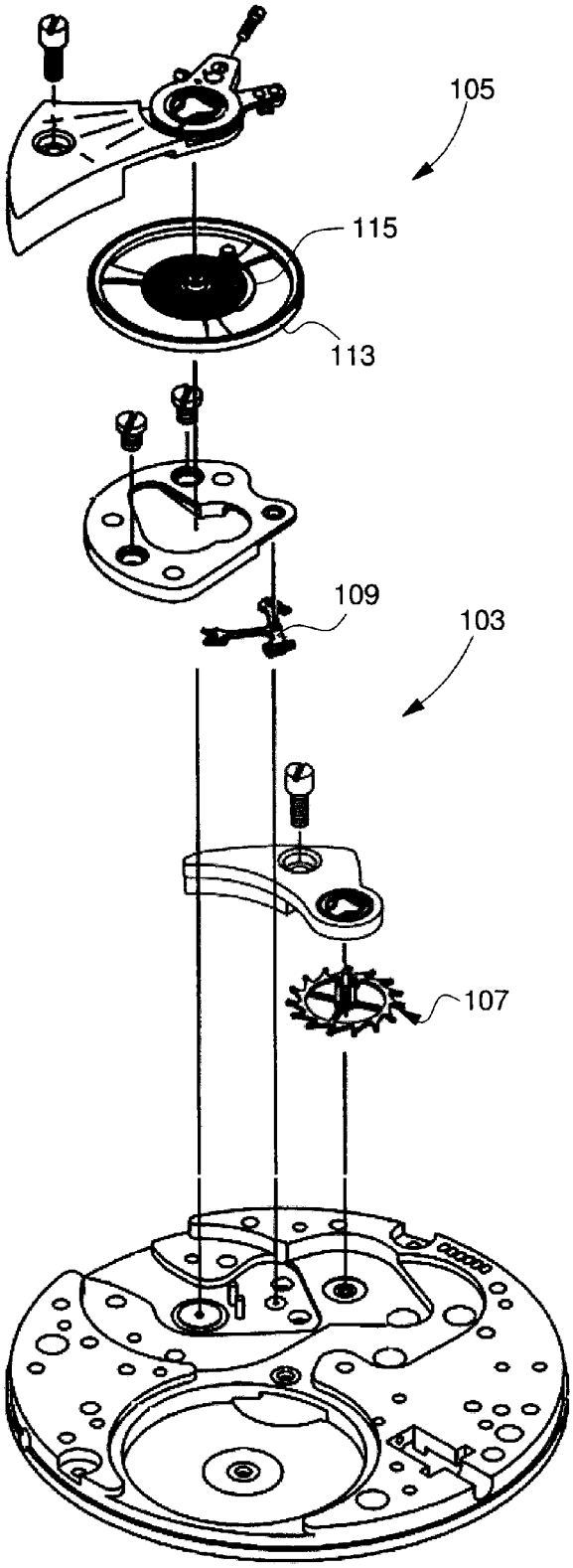
FIG. 17 is an exploded view of a timepiece movement according to the invention.
Figure 18:
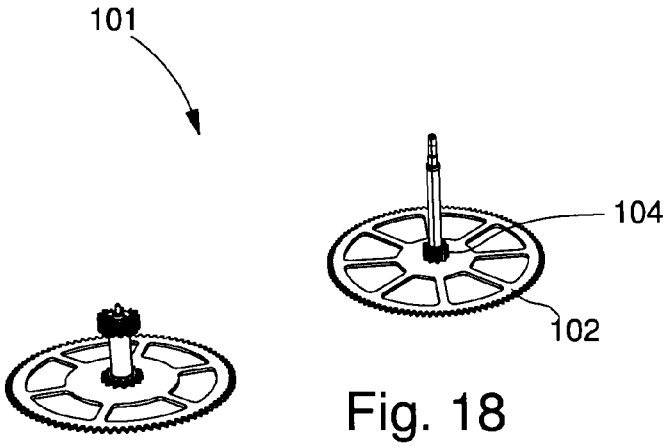
FIG. 18 is a partial view of a gear train according to the invention.
Figure 19:
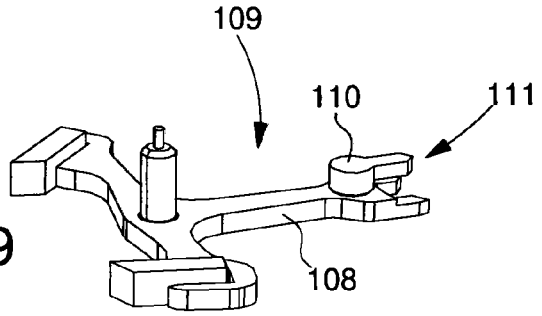
FIG. 19 is a view of pallets according to the invention.
Figure 20:
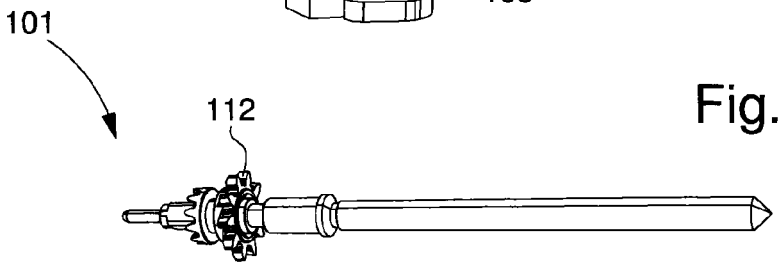
FIG. 20 is a view of a winding stem according to the invention.
Figure 21:
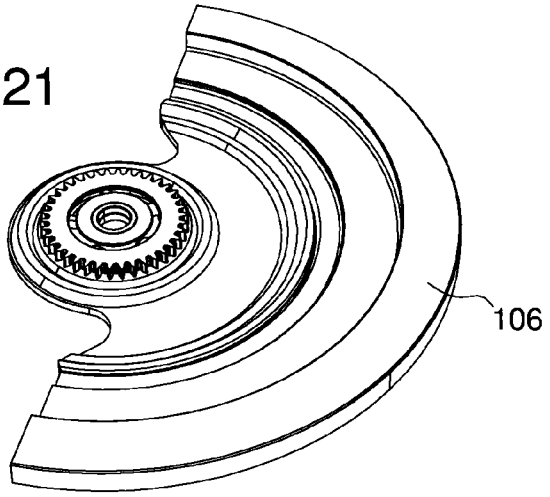
FIG. 21 is a view of an oscillating weight according to the invention.

According to a second embodiment of the invention illustrated, in particular, in FIGS. 14 and 15, timepiece assortment 31, 41, 51 includes a timepiece component 33, 43 fixed to an arbor 35 with the aid of a fixing element 37, 47 and of a driving-in member 39, 49. Advantageously according to the invention, fixing element 37, 47 is made of an at least partially amorphous metal alloy, is secured to timepiece component 33, 43 and to driving-in member 39, 49 by partial respective insertion as seen in FIGS. 14 and 15. Further, advantageously according to the invention, driving-in member 39, 49 includes a hole 38, 48 into which arbor 35 is driven.

It is understood advantageously according to the invention, that simply by partially covering timepiece component 33, 43 and driving-in member 39, 49 with fixing element 37 47, it is no longer necessary to implement adhesive bonding. Indeed, under certain conditions explained below, an at least partially amorphous metal alloy advantageously makes it possible to adopt the shape of any object in the manner of a deformable paste. This malleability of fixing element 37, 47 combined with the surface roughness of timepiece component 33, 43 and of driving-in member 39, 49 offers sufficient adherence for a timepiece application.

Advantageously according to the invention, according to a first alternative of the second embodiment, assortment 31 includes a driving-in member 39 which is mounted against a shoulder 36 of arbor 35, as illustrated in FIG. 14. This first alternative prevents timepiece component 33 from touching arbor 35. Indeed, preferably according to the invention, timepiece component 33 includes, like driving-in member 39, an opening 34, but of larger cross-section than hole 38.

According to a second alternative of the second embodiment, assortment 41 includes, conversely, a timepiece component 33 which is mounted against a shoulder 36 of arbor 35, as illustrated in FIG. 15. This second alternative guarantees optimum verticality of timepiece component 33 relative to arbor 35. Indeed, preferably according to the invention, since timepiece component 33 is pressed between shoulder 36 and driving-in member 39, its position has fewer degrees of freedom.

Preferably according to the invention, it was found that at least one fifth of the height of timepiece component 33, 43 and of the height of driving-in member 39, 49 covered by fixing element 37, 47 provides secure attachment when the height of timepiece component 33, 43 and/or the height of driving-in member 39, 49 are each comprised between 100 and 500 μm.

Preferentially according to the invention, fixing element 37, 47 is a magnesium-based, titanium-based, zirconium-based, iron-based, cobalt-based, gold-based, palladium-based or platinum-based alloy. More specifically, a fixing element 37, 47 formed by an alloy with an at least partially amorphous structure of the ZrTiCuNiBe, PdCuNiP or PtCuNiP type has proved satisfactory in each case.

Further, driving-in member 39, 49 is preferably a metal or a metal alloy such as stainless steel, brass or nickel silver.

Figure 16:
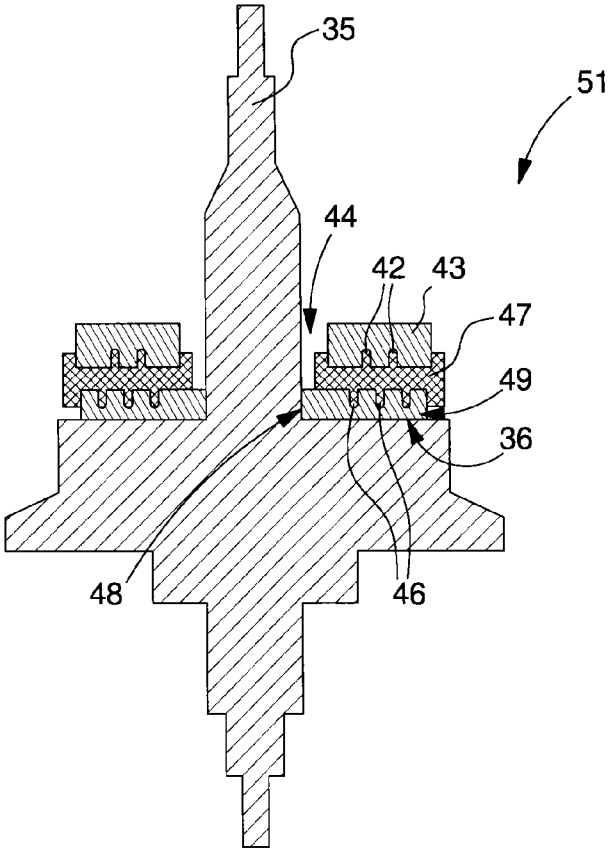
FIG. 16 is a cross-sectional view of steps for an assortment according to a variant of FIG. 14.

According to a variant of the second embodiment seen in FIG. 16, assortment 51 includes a timepiece component 43 formed with at least one recess 42 for increasing the surface contact with fixing element 47. It is also seen that driving-in member 49 may also include at least one recess 46. Recesses 42, 46 may be blind or through recesses and can be positioned in any manner facing fixing element 47.

In the example illustrated in FIG. 16, driving-in member 49 is mounted against a shoulder 36 of arbor 35. However, of course, this variant with a timepiece component 43 formed with at least one recess 42 and/or a driving-in member 49 formed with at least one recess 46 may also be assembled according to the aforecited second alternative of FIG. 15, that is to say with the timepiece component 43 mounted against shoulder 36 of arbor 35.

It is immediately understood that timepiece assortment 31, 41, 51 can thus form all or part of a gear train 101, of an escapement system 103 or of a resonator 105. More specifically, timepiece component 33, 43 may thus form a wheel 102, a pinion 104, 112 of an oscillating weight 106, a spring (such as for example a mainspring), an escape wheel 107, a lever 108 of a pallets 109, a guard pin 110 of a pallets 109, a fork 111 of a pallets 109, a balance 113, a roller (such as for example a double roller holding an impulse pin) or a balance spring 115.

Methods for the assembly of a timepiece assortment according to the invention will now be described with reference to FIGS. 1 to 16. According to a first embodiment of timepiece assortment 1, 11, 21, the method according to the invention includes a first step a) for manufacturing a timepiece component 3, 13, 23 and a fixing element 7', 27' made of an at least partially amorphous metal alloy provided with a hole 8', 28'. For better comprehension of the method, a balance spring 23 is used as a timepiece component in the example of FIGS. 1 to 5. Of course, the timepiece component 3, 13, 23 is not limited to a balance spring.

Figure 1:
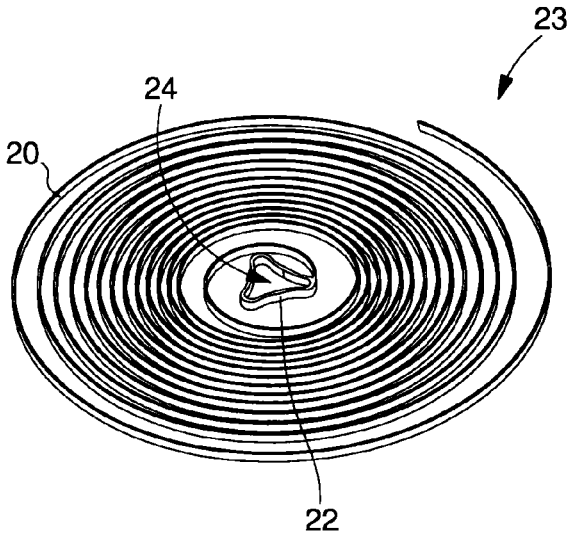
FIGS. 1 to 5 are perspective views of steps for the assembly of an assortment according to a first embodiment of the invention.
Figure 2:
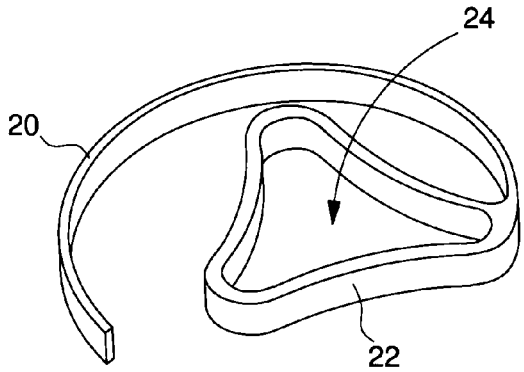

As illustrated in FIGS. 1 and 2, timepiece component 23 includes a collet 22 including a substantially triangular opening 24 and a strip 20 coiled on itself. A similar opening 4 and timepiece component 3 are also shown schematically in FIG. 6.

Figure 3:
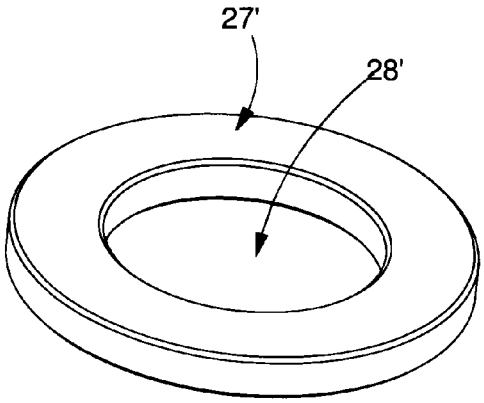

Further, FIG. 3 shows a fixing element 27' of the invention of substantially annular shape and including a through hole 28'. This fixing element 27' is a blank, i.e. a preform intended to be deformed in step b) to form the final fixing element 27. It is thus understood that its shape is not of paramount importance, nor is the geometry of hole 28' as explained below. A similar hole 8' and fixing element 7' are also shown schematically in FIG. 6.

However, the presence of a hole 8', 28' at this stage is not essential. Indeed, alternatively, a disc could be used instead of an element of substantially annular shape. The hole could then be formed when the disc is hot-deformed.

Preferentially according to the invention, fixing element 7', 27' is a magnesium-based, titanium-based, zirconium-based, iron-based, cobalt-based, gold-based, palladium-based or platinum-based alloy. More specifically, a fixing element 7', 27' formed by an alloy with an at least partially amorphous structure of the ZrTiCuNiBe, PdCuNiP or PtCuNiP type has proved satisfactory in each case.

Fixing element 7', 27' may be formed from a band or a wire and then cut therein. Melt spinning or casting followed by quenching may be envisaged.

Figure 4:
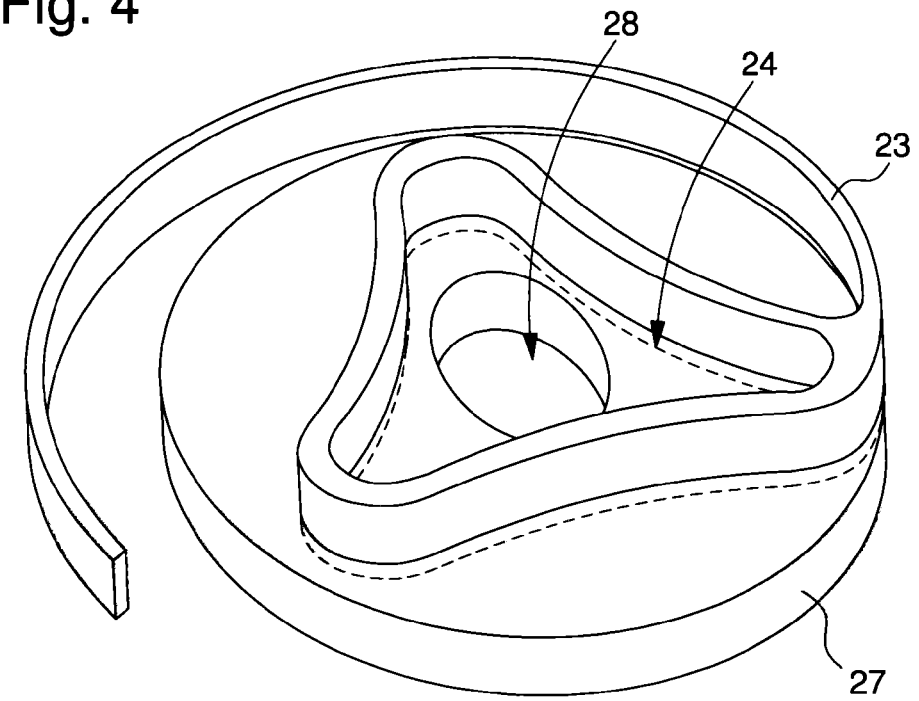
Figure 5:
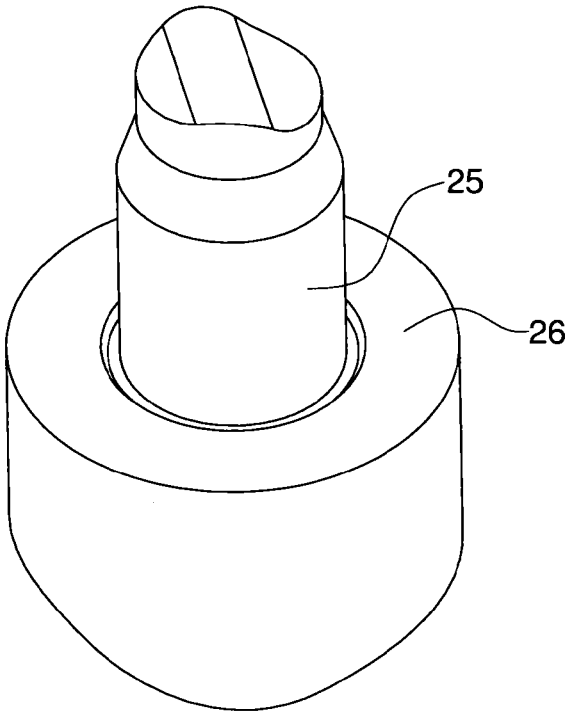
Figure 6:
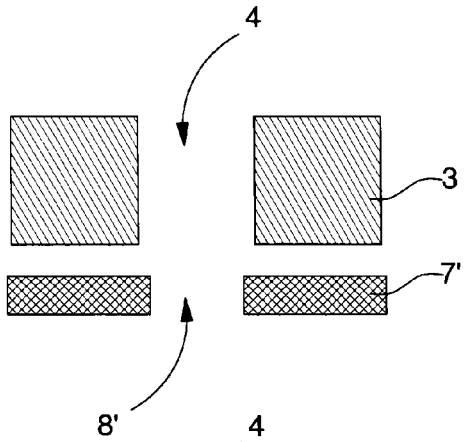
FIGS. 6 to 8 are cross-sectional views of steps for the assembly of an assortment according to a first embodiment of the invention.
Figure 7:
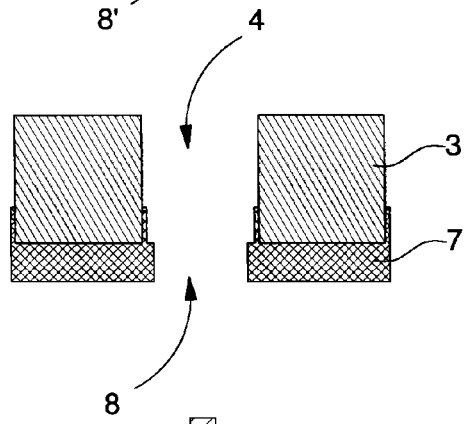

The method according to the invention continues with the second step b) for partially inserting timepiece component 3, 23 into fixing element 7', 27' heated between its vitreous transition temperature Tg and its crystallisation temperature Tx in order to form a timepiece component 3, 23-fixing element 7, 27 assembly as illustrated in FIGS. 4 and 7.

Indeed, when heated between its vitreous transition temperature Tg and its crystallisation temperature Tx, the viscosity of fixing element 7', 27' made of an at least partially amorphous metal alloy drops until it is possible to insert timepiece component 3, 23 simply by pressing. As seen in FIGS. 4 and 7, fixing element 7', 27' is then deformed to eventually form fixing element 7, 27 partially covering timepiece component 3, 23.

Figure 10:
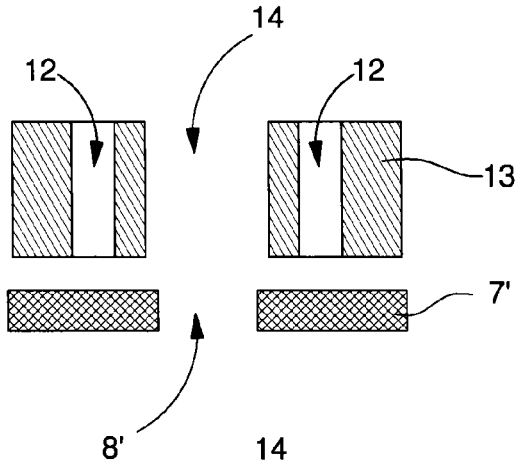
FIGS. 10 to 12 are cross-sectional views of steps for the assembly of an assortment according to a variant of FIGS. 6 to 8.
Figure 11:
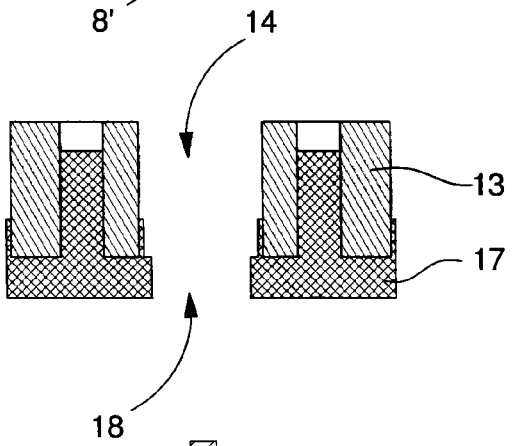

According to a variant of the first embodiment illustrated in FIGS. 10 and 11, in this step b), the method also enables the recess(es) 12 of timepiece component 13 to be at least partially filled by fixing element 17 in addition to said covering explained above. It is immediately clear that this variant provides superior adherence through the increased contact surface between the fixing element 17 and timepiece component 13.

In order to guarantee a predetermined geometry of the fixing element at the end of step b), a template may be used to limit the deformation of fixing element 7, 17, 27 to certain dimensions such as that of the cross-section of hole 8, 18, 28 and that of the peripheral wall of fixing element 7, 17, 27 or, as explained above, to form hole 8, 18, 28 in the blank disc of the fixing element.

In addition to the template or provided in isolation, a spacer may be used in step b) to guarantee the depth of penetration of the timepiece component 3, 13, 23 into fixing element 7, 17, 27. This spacer is, for example, used to guarantee that a minimum thickness of 50 μm of fixing element 7, 17, 27 remains after step b), that is to say that, in the first alternative of FIGS. 8 and 12, there is at least 50 μm of fixing element 7, 17, 27 between shoulder 6 and timepiece component 3, 13, 23.

Optionally, after step b) and before step c) explained below, the method may include an intermediate step d) for maintaining the timepiece component 3, 13, 23-fixing element 7, 17, 27 assembly above the vitreous transition temperature Tg of fixing element 7, 17, 27 in order to make fixing element 7, 17, 27 more ductile. Indeed, this temperature maintenance makes it possible to initiate crystallisation, particularly at hole 8, 18, 28, which can facilitate the final step c) explained below.

Finally, the method ends with step c) for driving an arbor 5, 25 into the hole 8, 18, 28 of the fixing element 7, 17, 27 to form the timepiece assortment 1, 11, 21, that is to say a secure assembly formed of an arbor 5, 25, a fixing element 7, 17, 27 and a timepiece component 3, 13, 23.

According to a first alternative of step c), fixing element 7, 17 is pressed against the shoulder 6, 26 of arbor 5, 25, as illustrated in FIGS. 4-5, 8 and 12. According to a second alternative of step c), timepiece component 3, 13, 23 is pressed against shoulder 6, 26 of arbor 5, 25, as illustrated in FIG. 9.

It is understood, advantageously according to the first embodiment of the invention, that timepiece component 3, 13, 23 including an opening 4, 14, 24 which extends around the hole 8, 18, 28 of fixing element 7, 17, 27 with a larger cross-section, is subjected to only minimum stress, or no stress in step c), i.e. that almost all, or all of the driving-in stress exerted in step c) will be borne by fixing element 7, 17, 27. This makes it possible to leave a gap, i.e. an area devoid of material as seen in FIGS. 8, 9 and 12, between the wall of timepiece component 3, 13, 23 delimiting the opening 4, 14, 24 and the outer diameter of arbor 5, 25, against which fixing element 7, 17, 27 is driven.

According to a second embodiment of timepiece assortment 31, 41, 51, the method according to the invention includes a first step a') for manufacturing a timepiece component 33, 43, a fixing element made of an at least partially amorphous metal alloy and a driving-in member 39, 49 provided with a hole 38, 48.

Although not illustrated, timepiece component 33, 43 and the fixing element may be of substantially identical shape to those 3, 13, 23, 7', 27' of the first embodiment. It is therefore understood that the shape of the fixing element is not of paramount importance. Preferably according to the invention, driving-in member 39, 49 is in the form of a washer and includes a hole 38, 48 whose geometry must be precisely controlled.

The method according to the invention continues with the second step b') for partially inserting timepiece component 33, 43 and driving-in member 39, 49 into the fixing element heated between its vitreous transition temperature Tg and its crystallisation temperature Tx in order to form a timepiece component 33, 43-fixing element 37, 47-driving-in member 39, 49 assembly.

Figure 13:
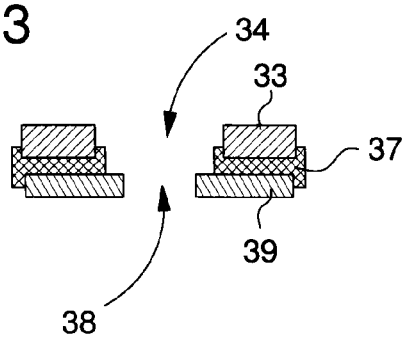
FIGS. 13 and 14 are cross-sectional views of steps for the assembly of an assortment according to a second embodiment of the invention.

Indeed, when heated to between its vitreous transition temperature Tg and its crystallisation temperature Tx, the viscosity of the fixing element made of an at least partially amorphous metal alloy is reduced until it is possible to insert timepiece component 33, 43 simply by pressing. As seen in FIGS. 13 and 16, the fixing element is then deformed to eventually form fixing element 37, 47 partially covering timepiece component 33, 43 and driving-in member 39, 49.

According to a variant of the second embodiment illustrated in FIG. 16, in this step b'), the method also enables the recess(es) 42 of timepiece component 43 and/or the recess (es) 46 of driving-in member 49 to be at least partially filled by fixing element 47 in addition to said covering explained above. It is immediately clear that this variant provides superior adherence through the increased contact surface between the fixing element 47 and timepiece component 43 and/or the fixing element 47 and driving-in member 49.

In order to guarantee a predetermined geometry of the fixing element at the end of step b'), a template may be used to limit the deformation of fixing element 37, 47 to certain dimensions such as that of the inner wall and that of the peripheral wall of fixing element 37, 47.

In addition to the template or provided in isolation, a spacer may be used in step b') to guarantee the depth of penetration of the timepiece component 33, 43 and of the driving-in member 39, 49 into fixing element 37, 47. This spacer is used, for example, to guarantee a minimum thickness of 50 μm of fixing element 37, 47 between timepiece component 33, 43 and driving-in member 39, 49.

Finally, the method ends with step c') for driving an arbor 35 into the hole 38, 48 of the driving-in member 39, 49 to form the timepiece assortment 31, 41, 51, that is to say a secure assembly formed of an arbor 35, a driving-in member 39, 49, a fixing element 37, 47 and a timepiece component 33, 43.

According to a first alternative of step c'), driving-in member 39, 49 is pressed against the shoulder 36 of arbor 35, as illustrated in FIGS. 14 and 16. According to a second alternative of step c'), timepiece component 33, 43 is pressed against shoulder 36 of arbor 35, as illustrated in FIG. 15.

It is understood, advantageously according to the second embodiment of the invention, that timepiece component 33, 43 including an opening 34, 44 which extends around the hole 38, 48 of driving-in member 39, 49 with a larger cross-section, is not subjected to any stress in step c'), i.e. almost all, or all of the driving-in stress exerted in step c') will be borne by driving-in member 39, 49. This makes it possible to leave a gap, i.e. an area devoid of material as seen in FIGS. 14, 15 and 16, between the wall of timepiece component 33, 43 delimiting the opening 34, 44, and the outer diameter of arbor 35, against which driving-in member 39, 49 is driven.

Further, according to these two embodiments, it is understood, advantageously according to the invention, that fixing element 7, 17, 27 37, 47 made of an at least partially amorphous metal alloy will perfect adopt the shape of a portion of the timepiece component 3, 13, 23, 33, 43 and, where appropriate, of driving-in member 39, 49, allowing said fixing element, in combination with the surface roughness of timepiece component 3, 13, 23, 33, 43 and, where appropriate, of driving-in member 39, 49, to adhere thereto without requiring implementation of adhesive bonding.

Of course, the present invention is not limited to the illustrated example but is capable of various variants and alterations that will appear to those skilled in the art. In particular, the geometry of the timepiece component 3, 13, 23, 33, 43 may differ without losing the advantages of the present description.

Step c), c') of driving in arbor 5, 25, 35 could also occur at a higher temperature than the vitreous transition temperature Tg of the at least partially amorphous metal alloy in order to slightly soften said alloy and decrease the stresses on the material of the timepiece component 3, 13, 23, 33, 43 while maintaining good adherence. Thus, by way of example, the method could include a first phase c1) for heating the arbor above the vitreous transition temperature of the fixing element and a second phase c2) for driving the arbor into the hole of the fixing element or of the driving-in member in order to raise the temperature of the contact surface of the fixing element above its vitreous transition temperature to locally soften the fixing element and decrease the stresses on the material of the timepiece component while maintaining good adherence.

This heating may also facilitate the creation of a hole for the passage of the arbor in the case where a disc is used to form the fixing element in step a). Finally, this configuration would also make it possible to reduce the risks of detachment of the assembly formed in step b), b').

It is also possible to act on the surface structuring of arbor 5, 25, 35 in order to improve adherence in driving-in step c), c').

Further, the use of an arbor 5, 25, 35 with a low expansion coefficient is preferable to limit shrinkage during cooling whether it is performed in step b), b') or c), c').

Finally, from reading the above methods it is understood that it is possible to form several assemblies at the same time. Also, by way of example, the timepiece components could be fixedly held to their etching wafer and the fixing elements to their strip or wire to assemble them to each other by wafer scale assembling in securing step b), b'). Likewise, several assemblies could be driven onto their respective arbors in the same step c), c').

What is claimed is:

1. A method of assembling a timepiece assortment comprising the following steps:

a) separately manufacturing a timepiece component and a fixing element, the fixing element being manufactured from an at least partially amorphous metal alloy;

b) partially inserting at least one portion of the timepiece component into the thickness of the fixing element heated to between its vitreous transition temperature and its crystallisation temperature in order to form a timepiece component fixing element assembly;

c) driving an arbor into a hole of the fixing element to form the timepiece assortment so as to leave a gap between timepiece component and the arbor.

2. The method according to claim 1, wherein the hole is formed in step a), in step b) or in step c).

3. The method according to claim 1, wherein between step b) and step c), the method also includes the following step:

d) maintaining the timepiece component fixing element assembly above the vitreous transition temperature of the fixing element to make the fixing element more ductile.

4. The method according to claim 1, wherein step c) also comprises the following phases:

c1) heating the arbor to above the vitreous transition temperature of the fixing element;

c2) driving the arbor into the hole of the fixing element to raise the temperature of the contact surface of the fixing element above the vitreous transition temperature in order to locally soften the fixing element and decrease the stresses on the material of the timepiece component while maintaining good adherence.

5. The method according to claim 1, wherein the timepiece component is pressed against a shoulder of the arbor in the driving-in step c).

6. The method according to claim 1, wherein the fixing element is pressed against a shoulder of the arbor in the driving-in step c).

7. The method according to claim 1, wherein the timepiece component includes at least one recess for increasing the contact surface with the fixing element.

8. The method according to claim 1, wherein a template is used in step b) in order to guarantee the geometry of the fixing element.

9. The method according to claim 1, wherein a spacer is used in step b) to guarantee the depth of penetration of the timepiece component into the thickness of the fixing element.

10. A method of assembling a timepiece assortment comprising the following steps:

a') separately manufacturing a timepiece component, a fixing element made of an at least partially amorphous metal alloy and a driving-in member provided with a hole;

b') partially inserting at least one portion of the timepiece component and of the driving-in member into the thickness of the fixing element heated to between its vitreous transition temperature and its crystallisation temperature to form a timepiece component fixing element driving-in member assembly;

c') driving an arbor into the hole in the driving-in member to form the timepiece assortment so as to leave a gap between timepiece component and the arbor.

11. The method according to claim 10, wherein the timepiece component is pressed against a shoulder of the arbor in the driving-in step c').

12. The method according to claim 10, wherein the driving-in member is pressed against a shoulder of the arbor in the driving-in step c').

13. The method according to claim 10, wherein the timepiece component includes at least one recess for increasing the contact surface with the fixing element.

14. The method according to claim 10, wherein the driving-in member includes at least one recess for increasing the contact surface with the fixing element.

15. The method according to claim 10, wherein a template is used in step b') to guarantee the geometry of the fixing element.

16. The method according to claim 10, wherein a spacer is used in step b') to guarantee the depth of penetration of the timepiece component and of the driving-in member into the thickness of the fixing element.

* * * * *